US011833385B1

(12) United States Patent
Ross et al.

(10) Patent No.: US 11,833,385 B1
(45) Date of Patent: Dec. 5, 2023

(54) EXERCISE BAR FOR USE WITH FLEXIBLE RESISTANCE BANDS

(71) Applicant: Exemplar Design, LLC, Mason, OH (US)

(72) Inventors: Adam L. Ross, Loveland, OH (US); Mauricio Delgado, South Jordan, UT (US)

(73) Assignee: Exemplar Design, LLC, Mason, OH (US)

( * ) Notice: Subject to any disclaimer, the term of this patent is extended or adjusted under 35 U.S.C. 154(b) by 0 days.

(21) Appl. No.: 18/189,311

(22) Filed: Mar. 24, 2023

(51) Int. Cl.
*A63B 21/072* (2006.01)
*A63B 21/055* (2006.01)

(52) U.S. Cl.
CPC ..... *A63B 21/0724* (2013.01); *A63B 21/0555* (2013.01)

(58) Field of Classification Search
CPC ..... A63B 21/00185; A63B 21/02; A63B 21/0552; A63B 21/0557; A63B 21/0722; A63B 21/024; A63B 21/0726; A63B 21/075; A63B 21/151; A63B 21/152; A63B 21/153; A63B 21/159; A63B 21/4001; A63B 21/4017; A63B 21/4023
See application file for complete search history.

(56) References Cited

U.S. PATENT DOCUMENTS

| | | | | |
|---|---|---|---|---|
| 5,509,873 | A * | 4/1996 | Corn | A63B 21/4043 482/127 |
| 11,033,774 | B1 * | 6/2021 | Clarke | A63B 21/00185 |
| 2007/0173387 | A1 * | 7/2007 | Wu | A63B 21/169 482/121 |
| 2017/0274239 | A1 * | 9/2017 | Barella | A63B 23/03525 |
| 2020/0269080 | A1 * | 8/2020 | Jaquish | A63B 21/00065 |
| 2021/0244995 | A1 * | 8/2021 | Andrei | A63B 21/0051 |
| 2021/0402246 | A1 * | 12/2021 | Stegeman | A63B 21/16 |

OTHER PUBLICATIONS

TRX Bandit, 222.trxtraining.com/products/bandit, downloaded Mar. 24, 2023.

* cited by examiner

*Primary Examiner* — Sundhara M Ganesan
*Assistant Examiner* — Zachary T Moore
(74) *Attorney, Agent, or Firm* — BakerHostetler

(57) ABSTRACT

An exercise-bar is provided for use with flexible resistance bands. The exercise-bar includes a rigid elongated bar; and a pair of rotating resistance band sheaves respectively installed at the opposing axial ends of the rigid bar. Each band sheave includes: a rotor secured for free rotation to an axial end of the rigid elongated bar; a band-collar carried on a band-support portion of the rotor and having an axial width to accommodate at least a width of a flexible resistance band thereabout; and a slotted cover shell carried on the rotor. The slotted cover shell includes an open axial end and a semi-circumferential cover portion covering a corresponding semi-circumferential portion of the band-collar and an axial slot extending into an axial end of the semi-circumferential cover portion and extending along at least the axial width of the band-collar.

20 Claims, 3 Drawing Sheets

EXERCISE BAR FOR USE WITH FLEXIBLE RESISTANCE BANDS

BACKGROUND

Flexible resistance bands are common exercise equipment in which a user performs exercises by pulling against the resistance of the bands. Typical accessories for use with such resistance bands usually only work with a certain type or brand of resistance band.

It is an object of the current disclosure to provide an exercise bar for use with resistance bands that allows for use with many different types of such resistance bands, may provide a smooth range of motion during the various exercises, may be easy and safe to use with multiple types of resistance bands and/or may be less prone to damage.

SUMMARY

In an aspect, an exercise-bar is provided for use with flexible resistance bands (or other similar forms of exercise bands). The exercise-bar includes a rigid elongated bar having first and second opposing axial ends; and a pair of rotating resistance band sheaves respectively installed at the first and second opposing axial ends. Each band sheave includes: (a) a rotor secured for free rotation to an axial end of the rigid elongated bar, the rotor including a band-support portion extending axially out from the axial end of the rigid elongated bar; (b) a band-collar carried on the band-support portion of the rotor and having an axial width to accommodate at least a width of a flexible resistance band thereabout; and (c) a slotted cover shell carried on the rotor. The slotted cover shell includes an open axial end, a semi-circumferential cover portion covering a corresponding semi-circumferential portion of the band-collar and an axial slot extending into an axial end of the semi-circumferential cover portion and extending along at least the axial width of the band-collar. The slotted cover shell's semi-circumferential cover portion is radially spaced from the band-collar by a radial distance to accommodate at least the thickness of the flexible resistance band therebetween, and the slotted cover shell's axial slot has a circumferential width to accommodate at least twice the thickness of the flexible resistance band therebetween.

In a more detailed embodiment, the band-collar of each rotating resistance band sheave includes a band-retention flange extending radially outward from an axial outer end thereof. In a further detailed embodiment, the slotted cover shell of each rotating resistance band sheave includes a bumper flange extending radially outwardly from the semi-circumferential cover portion approximate the open axial end. In yet a further detailed embodiment, the bumper flange extending radially outwardly from the semi-circumferential cover portion of each rotating resistance band sheave is formed from a rubber or a rubber-like material.

Alternatively, or in addition, the slotted cover shell of each rotating resistance band sheave is bell-shaped, such that a crown of the bell-shaped slotted cover shell is positioned approximate the axial end of the rigid elongated bar and a mouth of the bell-shaped slotted cover shell is positioned distal from the axial end of the rigid elongated bar and provides the open axial end of the slotted cover shell.

Alternatively, or in addition, the rigid elongated bar is a hollow aluminum rod, where the rotor of each band sheave includes a shaft secured for free rotation to an axial end of the hollow aluminum rod by a linear shaft bearing.

Alternatively, or in addition, the slotted cover shell of each rotating resistance band sheave includes a rubber or a rubberized bumper flange extending radially outwardly from the semi-circumferential cover portion approximate the open axial end.

In another aspect of the current disclosure, a resistance band sheave for attachment to an exercise accessory (such as, but not limited to, an exercise bar) is provided that includes: a rotor adapted to be secured for rotation to an exercise accessory, the rotor including an axially extending band-support portion; a band-collar carried on the band-support portion of the rotor and having an axial width to accommodate at least a width of a flexible resistance band thereabout; and a slotted cover shell carried on the rotor, including an open axial end and a semi-circumferential cover portion covering a corresponding semi-circumferential portion of the band-collar and an axial slot extending into an axial end of the semi-circumferential cover portion and extending along at least the axial width of the band-collar. The slotted cover shell semi-circumferential cover portion is radially spaced from the band-collar by a radial distance to accommodate at least the thickness of the flexible resistance band therebetween; and the slotted cover shell axial slot having a circumferential width to accommodate at least twice the thickness of the flexible resistance band therebetween.

In a detailed embodiment, the band-collar includes a band-retention flange extending radially outward from an axial outer end thereof. In a further detailed embodiment, the slotted cover shell includes a bumper flange extending radially outwardly from the semi-circumferential cover portion approximate the open axial end. In yet further detailed embodiment, the bumper flange extending radially outwardly from the semi-circumferential cover portion is formed from a rubber or a rubber-like material.

Alternatively, or in addition, the slotted cover shell is bell-shaped, where a crown of the bell-shaped slotted cover shell is adapted to be positioned approximate the exercise accessory; and a mouth of the bell-shaped slotted cover shell is positioned distal from the exercise accessory and provides the open axial end of the slotted cover shell.

Alternatively, or in addition, the rotor of each band sheave includes a shaft adapted to be secured for free rotation to the exercise accessory by a linear shaft bearing.

Alternatively, or in addition, the slotted cover shell is a rubber or a rubberized bumper flange extending radially outwardly from the semi-circumferential cover portion approximate the open axial end.

DETAILED DESCRIPTION

Figure 3A:
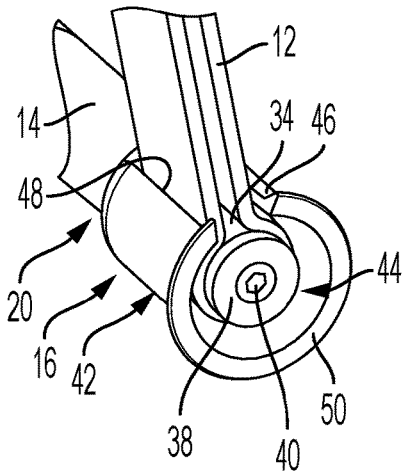
FIG. 3A is a perspective view of an exemplary rotating resistance band sheave of the exercise-bar of FIG. 1 with a flexible resistance band installed thereon.
Figure 3B:
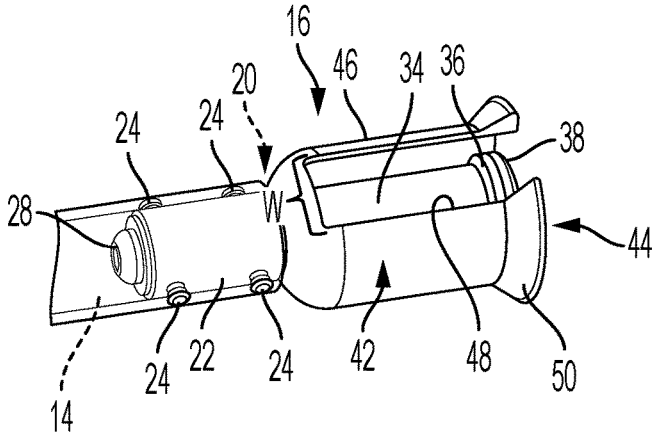
FIG. 3B is another perspective view of the exemplary rotating resistance band sheave of the exercise-bar of FIG. 1 without a resistance band installed thereon and showing the rigid elongated bar n phantom to illustrate how the exemplary rotating resistance band sheave may be fastened to the rigid elongated bar.
Figure 4:
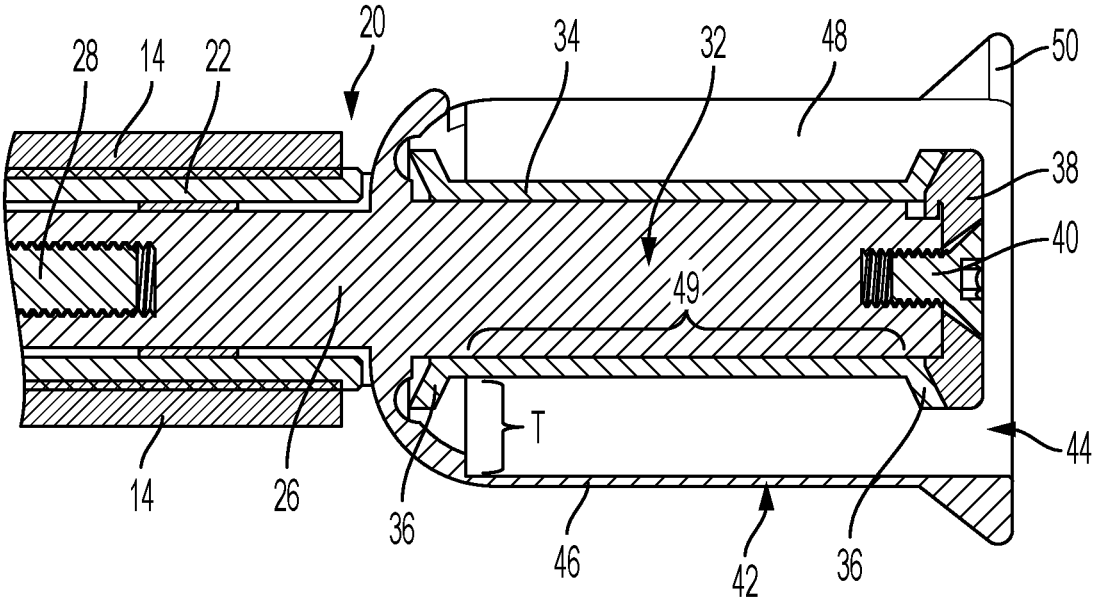
FIG. 4 is an elevational cross-sectional view of the exemplary rotating resistance band sheave without a flexible resistance band installed thereon.
Figure 5:
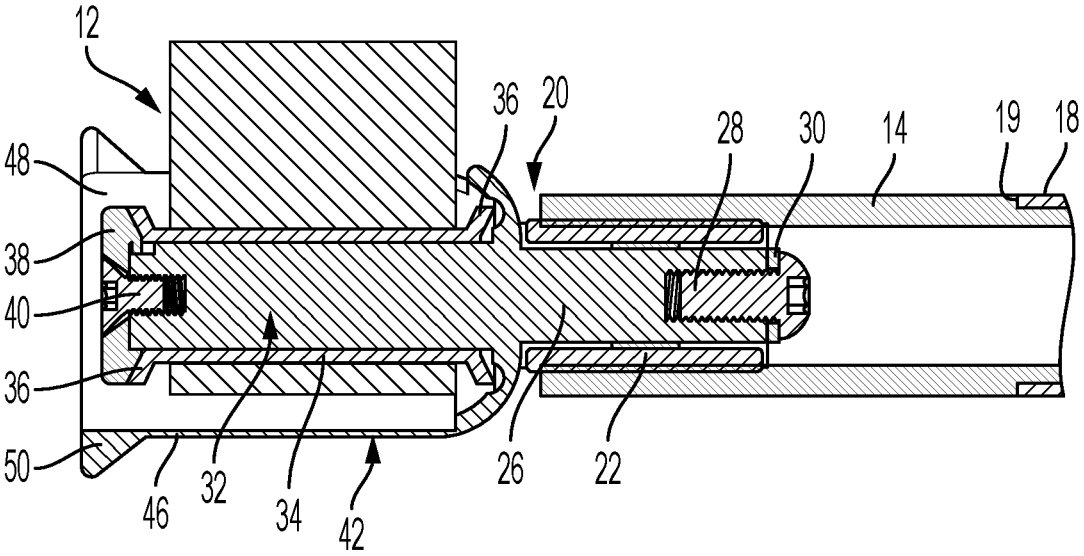
FIG. 5 is an elevational cross-sectional view of the exemplary rotating resistance band sheave with a flexible resistance band installed thereon.

Referring to FIGS. 1-5, an exemplary exercise-bar 10 for use with flexible resistance bands 12 includes a rigid elongated bar 14 and a pair of rotating resistance band sheaves 16 respectively installed at opposing axial ends 20 of the bar 14. In an embodiment, the bar 14 is a hollow aluminum rod and includes a pair of non-slip rubber grips 18 layered or bonded onto opposed portions of the bar's outer surface approximate the opposed axial ends 20. As shown in FIG. 5, the rubber grips 18 may be seated within (and optionally bonded within) a complimentary channel 19 formed about the outer circumference of the bar 14.

Focusing on FIGS. 3A, 3B, 4 and 5, the rotating resistance band sheaves 16 may each include a linear shaft bearing 22 secured within the hollow axial end 20 of the bar 14 by set screws 24 threaded into and through the bar 14 and against the outer surface of the linear shaft bearing 22. Each rotating resistance band sheave 16 further includes a rotor in the form of a rotor shaft 26 secured for free rotation within the linear shaft bearing 22 by a set screw 28 (and associated washer 30) threaded into the inner axial end of the rotor shaft 26. While the exemplary embodiment allows for 360° free rotation of the rotor shaft 26, it is within the scope of the disclosure that less than 360° free rotation may be provided in an alternate embodiment.

Referring primarily to FIGS. 4 and 5, the rotor shaft 26 has an axial band-support portion 32 that extends axially outward from the hollow axial end 20 of the bar 14, where the band-support portion 32 carries a flanged band-collar 34 thereon for accommodating the width of the flexible resistance bands 12 thereabout. The band-collar 34 may include two circumferential retainer flanges 36 extending radially outward from axial ends thereof for assisting with retaining the resistance bands 12 on the band-collar 34 when in use. As shown in FIG. 5, each retainer flange 36 may be angled axially outwardly and may have a radial height approximating (but less than) the thickness of the resistance bands 12. An end-cap 38 may be fastened by a screw 40 to the outer axial end of the band-support portion 32 of the rotor shaft 26 to secure the band-collar 34 onto the band-support portion 32 of the rotor shaft 26. It will be appreciated that, in an embodiment, the band-collar 34 may be integral with rotor shaft 26 such that the band-support portion 32 of the rotor shaft may be one and the same with the band-collar 34.

Focusing again on FIGS. 3A, 3B, 4 and 5, a slotted cover shell 42 is carried on the band-support portion 32 of the rotor shaft 26 so as to rotate with the rotor shaft 26. In an embodiment, the slotted cover shell 42 may be bell-shaped, where the crown of the bell-shape is approximate the axial end 20 of the bar 14 and the mouth of the bell is distal from the axial end 20 of the bar 14. In an embodiment the slotted cover shell 42 is molded integrally with the rotor shaft 26, but it can also be fastened or fixed to the rotor shaft as desired. The slotted cover shell 42 includes an open axial end 44 (i.e., the mouth of the bell-shape) and a semi-circumferential cover portion 46 (i.e. the waist of the bell-shape) covering a corresponding semi-circumferential portion of the band-collar 34. The slotted cover shell 42 further includes an axially extending slot 48 extending into an axial end of the semi-circumferential cover portion 46 and extending along at least the axial width of the band-receiving segment 49 (the segment between the retainer flanges 36) of the band-collar 34. The semi-circumferential cover portion 46 is radially spaced above the band-receiving segment 49 of the band collar 34 by a radial distance T to accommodate at least the thickness of the flexible resistance band 12 therebetween. The axially extending slot 48 has a circumferential width W to accommodate at least twice the thickness of the flexible resistance band 12 therebetween. The slotted cover shell 42 further may include a rubber or rubberized bumper flange 50 with flared tips extending outwardly about the circumference of the semi-circumferential cover portion 46 of the slotted cover shell 42.

In an embodiment the rotor shaft 26, collar 34 and cover portion 46 are formed from steel or some other sufficiently rigid and rugged material or combination of materials. The bumper flange 50 may be molded to or bonded to (or attached in some other fashion to) the outer circumferential surface of the cover portion 46.

The exemplary exercise-bar 10 is designed to work with commonly available resistance bands and does not require the user to purchase any specific or specialized resistance bands. To install, as shown in FIG. 3A, the user loops the resistance band 12 and inserts the loop into the open axial end 44 of the slotted cover shell 42 and seats the loop of the resistance band 12 on the band-collar 34 (between flanges 36) while sliding or inserting the free ends of the bands into the axially extending slot 48 so that the free ends of the band extend out from the slot 48. The flange 36 (at least the axially outer flange 36) on the band-collar 34 securely holds the resistance band 12 in place during use (i.e., prevents the band 12 from sliding off).

Figure 1:
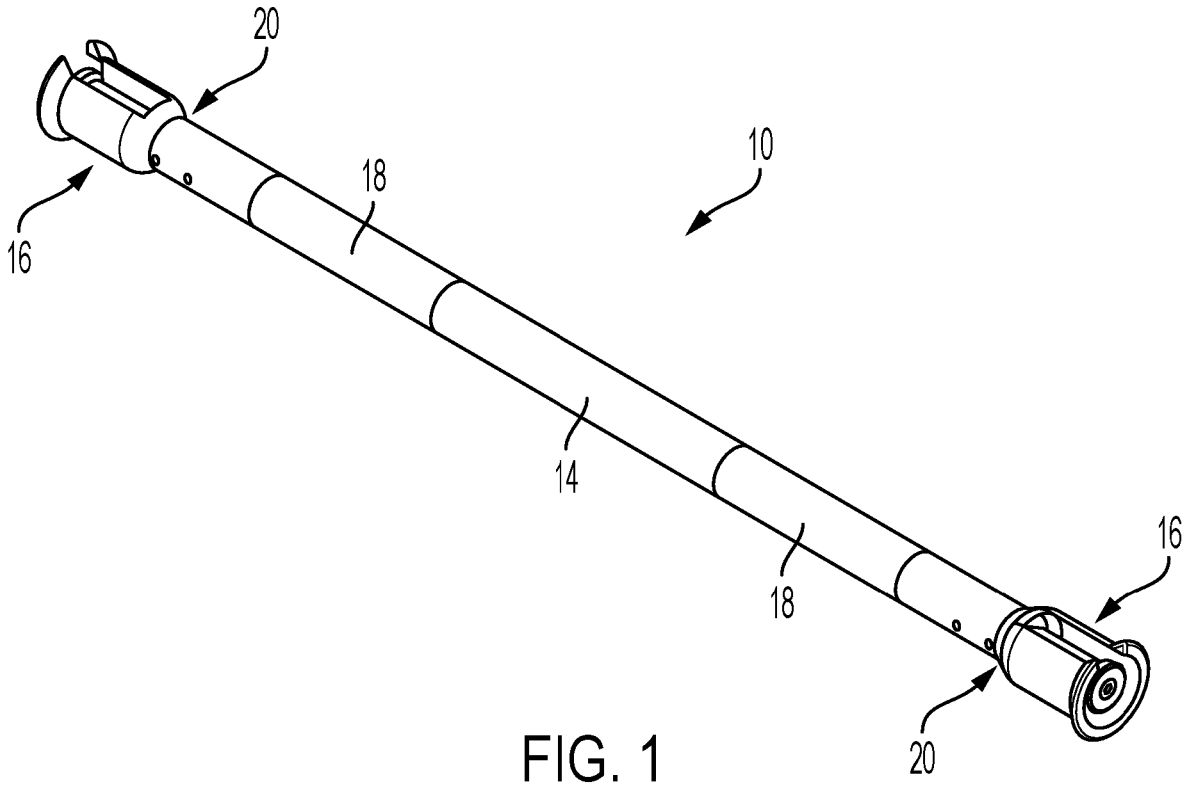
FIG. 1 is a perspective view of an exemplary exercise-bar for use with flexible resistance bands according to an embodiment.
Figure 2:
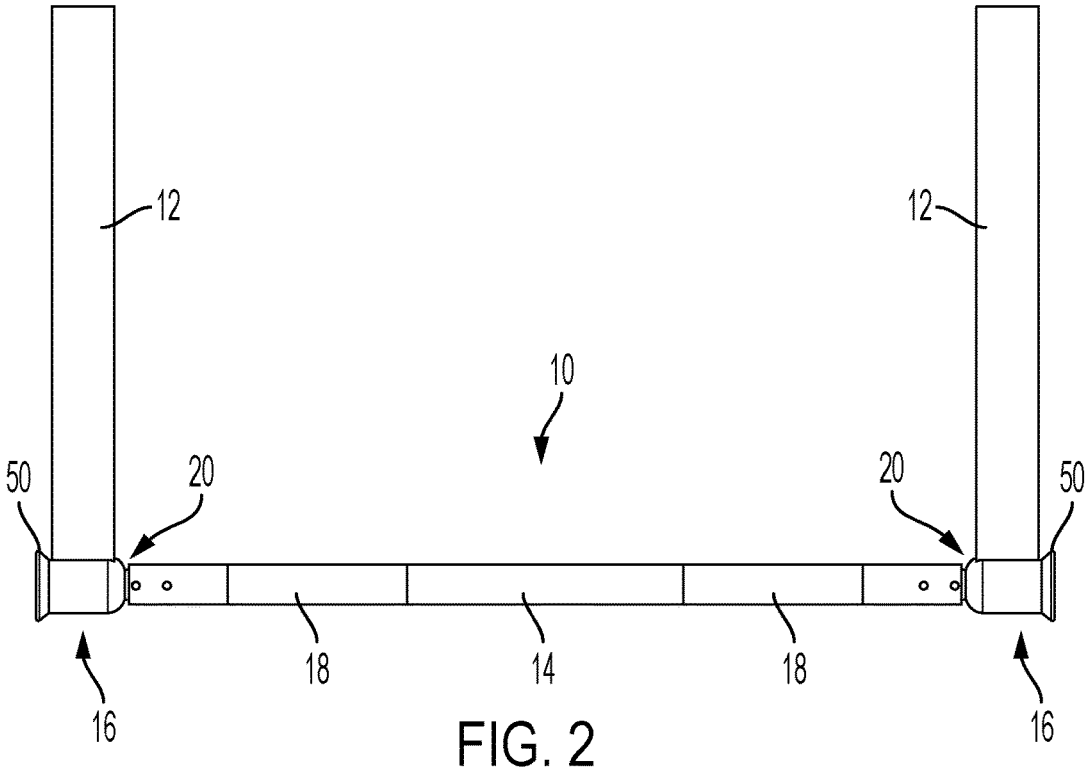
FIG. 2 an elevational side view of the exercise-bar of FIG. 1 showing as used with a pair of flexible resistance bands installed thereon.

When a pair of resistance bands 12 are installed as shown in FIG. 2, various exercises may be performed. For example, the user may step on the free ends of the bands to anchor the free ends to the ground and then grip the bar (at the grips 18) to perform bicep curls, squats or some other exercise against the resistance of the bands 12. The free rotation of the band sheaves 16 allow smooth transition of resistance through the entire range of motion during use as an exercise device. The rubber or rubberized flanges 50 are designed to prevent damage to floors or to the exercise-bar 10 during use—for example, if the exercise-bar 10 is dropped during use.

The exemplary rotating resistance band sheaves 16 are not limited for use with exercise bars. For example, such resistance band sheaves 16 may be adapted for use with other types of exercise apparatuses, systems and equipment, such as singular handles, foot-press structures, and so forth.

Having described the invention with reference to a primary exemplary embodiment of the exercise-bar 10 and associated resistance band sheaves 16, it is to be understood that the scope of the invention is not intended to be limited to this primary embodiment, as modifications may be made without departing from the scope of the appended claims. Likewise, the claims are drafted with the intention of not being limited to the embodiment(s) disclosed herein. It is also intended that the appended claims define the scope of the invention using (as much as possible) plain and customary terminology, and that specific structures or other limitations are not intended to be read from the specification into the meaning of any of the appended claims. It is also to be understood that it is not necessary to meet any of the stated objects or advantages discussed herein to fall within the scope of any appended claims, as such stated objects and advantages are exemplary in nature and others may exist that have not been expressly disclosed.

What is claimed is:

1. An exercise-bar for use with flexible resistance bands, comprising:

a rigid elongated bar having first and second opposing axial ends; and a pair of rotating resistance band sheaves respectively installed at the first and second opposing axial ends, each band sheave including:

a rotor secured for free rotation to the respective axial end of the first and second axial ends of the rigid elongated bar, the rotor including a band-support portion extending axially out from the respective axial end of the rigid elongated bar, a band-collar carried on the band-support portion of the rotor and having an axial width to accommodate at least a width of a flexible resistance band of the flexible resistance bands thereabout, and a slotted cover shell carried on the rotor, including an open axial end and a semi-circumferential cover portion covering a corresponding semi-circumferential portion of the band-collar and an axial slot extending into an axial end of the semi-circumferential cover portion and extending along at least the axial width of the band-collar;

the semi-circumferential cover portion of the slotted cover shell being radially spaced from the band-collar by a radial distance to accommodate at least a thickness of the flexible resistance band therebetween; and the axial slot of the slotted cover shell having a circumferential width to accommodate at least twice the thickness of the flexible resistance band therebetween.

2. The exercise-bar of claim 1, wherein the band-collar of each rotating resistance band sheave includes a band-retention flange extending radially outward from an axial outer end thereof.

3. The exercise-bar of claim 2, wherein the slotted cover shell of each rotating resistance band sheave includes a bumper flange extending radially outwardly from the semi-circumferential cover portion proximate the open axial end.

4. The exercise-bar of claim 3, wherein the bumper flange extending radially outwardly from the semi-circumferential cover portion of each rotating resistance band sheave is formed from a rubber material.

5. The exercise-bar of claim 1, wherein the slotted cover shell of each rotating resistance band sheave is bell-shaped, wherein:

a crown of the bell-shaped slotted cover shell is positioned proximate the respective axial end of the rigid elongated bar; and a mouth of the bell-shaped slotted cover shell is positioned distal from the respective axial end of the rigid elongated bar and provides the open axial end of the slotted cover shell.

6. The exercise-bar of claim 1, wherein the rigid elongated bar is a hollow aluminum rod.

7. The exercise-bar of claim 6, wherein the rotor of each band sheave includes a shaft secured for free rotation to the respective axial end of the first and second axial ends of the hollow aluminum rod by a linear shaft bearing.

8. The exercise-bar of claim 1, wherein the slotted cover shell of each rotating resistance band sheave includes a rubber or a rubberized bumper flange extending radially outwardly from the semi-circumferential cover portion proximate the open axial end.

9. An exercise-bar for use with flexible resistance bands, comprising:

a rigid elongated bar having first and second hollow opposing ends; and a pair of rotating resistance band sheaves respectively installed at the first and second opposing ends, each band sheave including:

a linear shaft bearing secured within the respective hollow end of the rigid elongated bar, a rotor shaft secured for rotation within linear shaft bearing, the rotor shaft having a band-support portion extending axially out from the respective hollow end of the rigid elongated bar, a band-collar carried on the band-support portion of the rotor shaft, having a pair of radial flanges circumferentially extending from opposite axial ends of the band-collar, the band collar having an axial width of a band-receiving segment between the radial flanges to accommodate at least a width of a flexible resistance band of the flexible resistance bands thereabout, and a slotted cover shell carried for rotation with the rotor shaft over the band-support portion of the rotor shaft, including an open axial end and a semi-circumferential cover portion covering a corresponding semi-circumferential portion of the band-receiving segment of the band-collar and an axial slot extending into an axial end of the slotted cover shell and extending along at least the axial width of the band-receiving segment of the band-collar;

the semi-circumferential cover portion of the slotted cover shell of each rotating resistance band sheave being radially spaced from the band-receiving segment by a radial distance to accommodate at least a thickness of the flexible resistance band therebetween;

the axial slot of the slotted cover shell of each rotating resistance band sheave having a circumferential width to accommodate at least twice the thickness of the flexible resistance band therebetween; and the slotted cover shell of each rotating resistance band sheave including a rubberized, circumferential bumper flange extending outwardly from the semi-circumferential cover portion proximate the open axial end.

10. The exercise-bar of claim 9, wherein the rigid elongated bar is a hollow aluminum rod.

11. An exercise-bar for use with flexible resistance bands, comprising:

a rigid elongated bar having first and second opposing axial ends; and a pair of rotating resistance band sheaves respectively installed at the first and second opposing axial ends, each band sheave including:

a rotor secured for free rotation to the respective axial end of the first and second axial ends of the rigid elongated bar, the rotor including a band-support portion extending axially out from the respective axial end of the rigid elongated bar, and a slotted cover shell carried for rotation with the rotor, including an open axial end and a semi-circumferential cover portion covering a corresponding semi-circumferential portion of the band-support portion and an axial slot extending into an axial end of the semi-circumferential cover portion and extending an axial distance to accommodate at least a width of a resistance band of the flexible resistance bands therein;

the semi-circumferential cover portion of the slotted cover shell being radially spaced from the band-support portion by a radial distance to accommodate at least a thickness of the flexible resistance band therebetween; and the axial slot of the slotted cover shell having a circumferential width to accommodate at least twice the thickness of the flexible resistance band therebetween.

12. A resistance band sheave for attachment to an exercise accessory, comprising:

a rotor adapted to be secured for rotation to an exercise accessory, the rotor including an axially extending band-support shaft portion;

a slotted cover shell carried on the rotor, including an open axial end and a semi-circumferential cover portion covering a corresponding semi-circumferential portion of the band-support shaft portion of the rotor and an axial slot extending into an axial end of the semi-circumferential cover portion and extending an axial distance inward to accommodate at least a width of a resistance band therein;

the semi-circumferential cover portion of the slotted cover shell being radially spaced from the band-support shaft portion of the rotor by a radial distance to accommodate at least a thickness of the flexible resistance band therebetween; and the axial slot of the slotted cover shell having a circumferential width to accommodate at least twice the thickness of the flexible resistance band therebetween.

13. The resistance band sheave of claim 12, wherein the band-support shaft portion of the rotor includes a band-collar secured thereon, the band-collar including a band-retention flange extending radially outward from an axial outer end thereof.

14. The resistance band sheave of claim 13, wherein the slotted cover shell includes a bumper flange extending radially outwardly from the semi-circumferential cover portion proximate the open axial end.

15. The resistance band sheave of claim 14, wherein the bumper flange extending radially outwardly from the semi-circumferential cover portion is formed from a rubber material.

16. The resistance band sheave of claim 12, wherein the slotted cover shell is bell-shaped, wherein:

a crown of the bell-shaped slotted cover shell is adapted to be positioned proximate the exercise accessory; and a mouth of the bell-shaped slotted cover shell is positioned distal from the exercise accessory and provides the open axial end of the slotted cover shell.

17. The resistance band sheave of claim 12, wherein the band-support shaft portion includes a shaft adapted to be secured for free rotation to the exercise accessory by a linear shaft bearing.

18. He resistance band sheave of claim 17, further comprising the linear shaft bearing.

19. The resistance band sheave of claim 18, wherein the slotted cover shell includes a rubber or a rubberized bumper flange extending radially outwardly from the semi-circumferential cover portion proximate the open axial end.

20. The resistance band sheave of claim 12, wherein the rotor is adapted to be secured for free rotation to the exercise accessory.

* * * * *